US008319815B2

(12) United States Patent
Chinuki et al.

(10) Patent No.: US 8,319,815 B2
(45) Date of Patent: Nov. 27, 2012

(54) STORAGE CABINET AND VIDEO CONFERENCE SYSTEM

(75) Inventors: Motonari Chinuki, Chiba (JP); Gen Minagi, Tokyo (JP); Maiko Kawarai, Tokyo (JP)

(73) Assignee: The Bank of Tokyo-Mitsubishi UFJ, Ltd., Tokyo (JP)

( * ) Notice: Subject to any disclaimer, the term of this patent is extended or adjusted under 35 U.S.C. 154(b) by 1098 days.

(21) Appl. No.: 12/237,688

(22) Filed: Sep. 25, 2008

(65) Prior Publication Data

US 2009/0218922 A1 Sep. 3, 2009

(30) Foreign Application Priority Data

Feb. 29, 2008 (JP) ..... 2008-1173

(51) Int. Cl.
*H04N 7/14* (2006.01)

(52) U.S. Cl. ..... 348/14.01; 348/14.12; 348/14.16

(58) Field of Classification Search .... 348/14.01–14.16, 348/836, 55.28; 705/27; 704/9; 108/50.11; 312/109, 7.1, 7.2; D14/127, 133; D16/203, D16/215

See application file for complete search history.

(56) References Cited

U.S. PATENT DOCUMENTS

| | | | | |
|---|---|---|---|---|
| 2002/0055835 | A1* | 5/2002 | Carcoba Olivares et al. | 704/9 |
| 2004/0056976 | A1* | 3/2004 | Strollo et al. | 348/373 |
| 2004/0080610 | A1* | 4/2004 | James et al. | 348/14.09 |
| 2004/0252184 | A1* | 12/2004 | Hesse et al. | 348/14.01 |
| 2005/0114703 | A1* | 5/2005 | Allen et al. | 713/201 |
| 2005/0137942 | A1* | 6/2005 | LaFleur | 705/27 |

FOREIGN PATENT DOCUMENTS

| | | |
|---|---|---|
| JP | 08-069342 | 12/1996 |
| JP | 2004-229051 | 8/2004 |
| JP | 2006-030913 | 2/2006 |

* cited by examiner

*Primary Examiner* — Melur Ramakrishnaiah
(74) *Attorney, Agent, or Firm* — Harness, Dickey & Pierce, PLC

(57) ABSTRACT

The present invention is to provide a storage cabinet that houses a terminal having a reader unit for reading information recorded on a recording medium. With this storage cabinet, a recording medium can be readily connected to the reader unit from any angle.

The storage cabinet houses a thin client terminal having a reader unit for reading authentication information from a recording medium. This storage cabinet includes a shelf board that is supported in a horizontal direction and has an opening into which the thin client terminal can be inserted, with the reader unit facing upward, and holding members that hold the thin client terminal inserted into the board member, with the reader unit being located higher than the shelf board.

11 Claims, 8 Drawing Sheets

STORAGE CABINET AND VIDEO CONFERENCE SYSTEM

CROSS-REFERENCE TO RELATED APPLICATIONS

This application claims the benefit and priority of JP 2008-1173, filed Feb. 29, 2008. The entire disclosure of the above application is incorporated herein by reference.

BACKGROUND OF THE INVENTION

1. Field of the Invention

The present invention relates to a storage cabinet that can house a terminal device to be used in a video conference or the like, and a video conference system that includes the storage cabinet.

2. Description of the Related Art

In recent years, the following conference system has been used in conferences in which a number of people participate. With this conference system, the participants sit in a circle, and a storage cabinet that houses a terminal device is placed at the center of the circle. Display devices such as liquid crystal displays are arranged in such positions so as to face the respective participants, and outputs from the terminal device are displayed on the display devices.

Also, in recent years, thin client systems have been introduced to many companies, firms, and the likes. In a thin client system, terminals have only minimum functions, and resources such as application software and files are managed by a server. Such a thin client system is operated through a terminal that can communicate with the server (see Sun Microsystems Homepage:—Thin Client http://jp.sun.com/products/desktop/sunray/, for example).

In such a thin client system, a single terminal performs user authentication, when a recording medium such as an authentication card having authentication information recorded thereon is inserted into the insertion slot of card reader. In this manner, the contents of the works the authenticated user can be viewed. With this thin client system used in a conventional conference system, conferences can be held while the work contents of the respective participants are viewed one by one through the single terminal.

The insertion slot of a card reader is normally provided on the front face of a thin client terminal. If a thin client terminal is set to a storage cabinet in a conventional manner, some of the participants need to go around the storage cabinet to insert a recording medium into the insertion slot, so that the authentication information can be read.

SUMMARY OF THE INVENTION

The present invention has been made in view of these circumstances, and an object thereof is to provide a storage cabinet that can house a terminal equipped with a reader unit that reads information recorded on a recording medium. In this storage cabinet, the recording medium can be readily connected to the reader unit from any angle.

A storage cabinet of the present invention is a storage cabinet that houses a terminal device having a reader unit for reading authentication information from a recording medium for authentication. This storage cabinet includes: a board member that is supported in a horizontal direction, and has an opening into which the terminal device can be inserted, with the reader unit facing upward; and a holding member that holds the terminal device inserted into the board member, with the reader unit being located higher than the board member.

In the above storage cabinet, the terminal device may be a thin client terminal that forms a thin client system in cooperation with a server. This storage cabinet may further include a protection member that is supported so as to cover the space above the reader unit of the terminal device inserted into the opening.

In the above storage cabinet, the board member may have a polygonal shape, and the protection member may be supported by support pillars standing at the center portions of the respective sides of the board member. The storage cabinet may further include a storage unit that houses a keyboard and a mouse connected to the terminal device.

A video conference system of the present invention includes: a storage cabinet that houses a terminal device having a reader unit for reading authentication information from a recording medium for authentication; the terminal device that is housed in the storage cabinet; and display devices that are arranged around the storage cabinet to display screens of the terminal device. In this video conference system, the storage cabinet includes: a board member that is supported in a horizontal direction, and has an opening into which the terminal device can be inserted, with the reader unit facing upward; and a holding member that holds the terminal device inserted into the board member, with the reader unit being located higher than the board member.

In the video conference system, the terminal device may be a thin client terminal that forms a thin client system in cooperation with a server. Also, the board member may have a polygonal shape, and the display devices may be arranged in positions along the respective sides of the board member.

In the video conference system, the storage cabinet may have a protection member that is supported so as to cover an upper portion of the reader unit of the terminal device inserted into the opening, and the protection member may be supported by support pillars standing at the center portions of the respective sides of the board member. Also, the storage cabinet may further include a storage unit that houses a keyboard and a mouse connected to the terminal device.

An output terminal for the display devices is provided on the back face of the terminal device. The uppermost plate member may be provided at such a distance from the immediately-below board member that cables can be easily connected to and disconnected from the output terminal.

The storage cabinet may also include a storage unit that houses a keyboard and a mouse connected to the terminal device.

DETAILED DESCRIPTION OF THE INVENTION

The following is a description of an embodiment of a storage cabinet of the present invention, with reference to the accompanying drawings.

Figure 1:
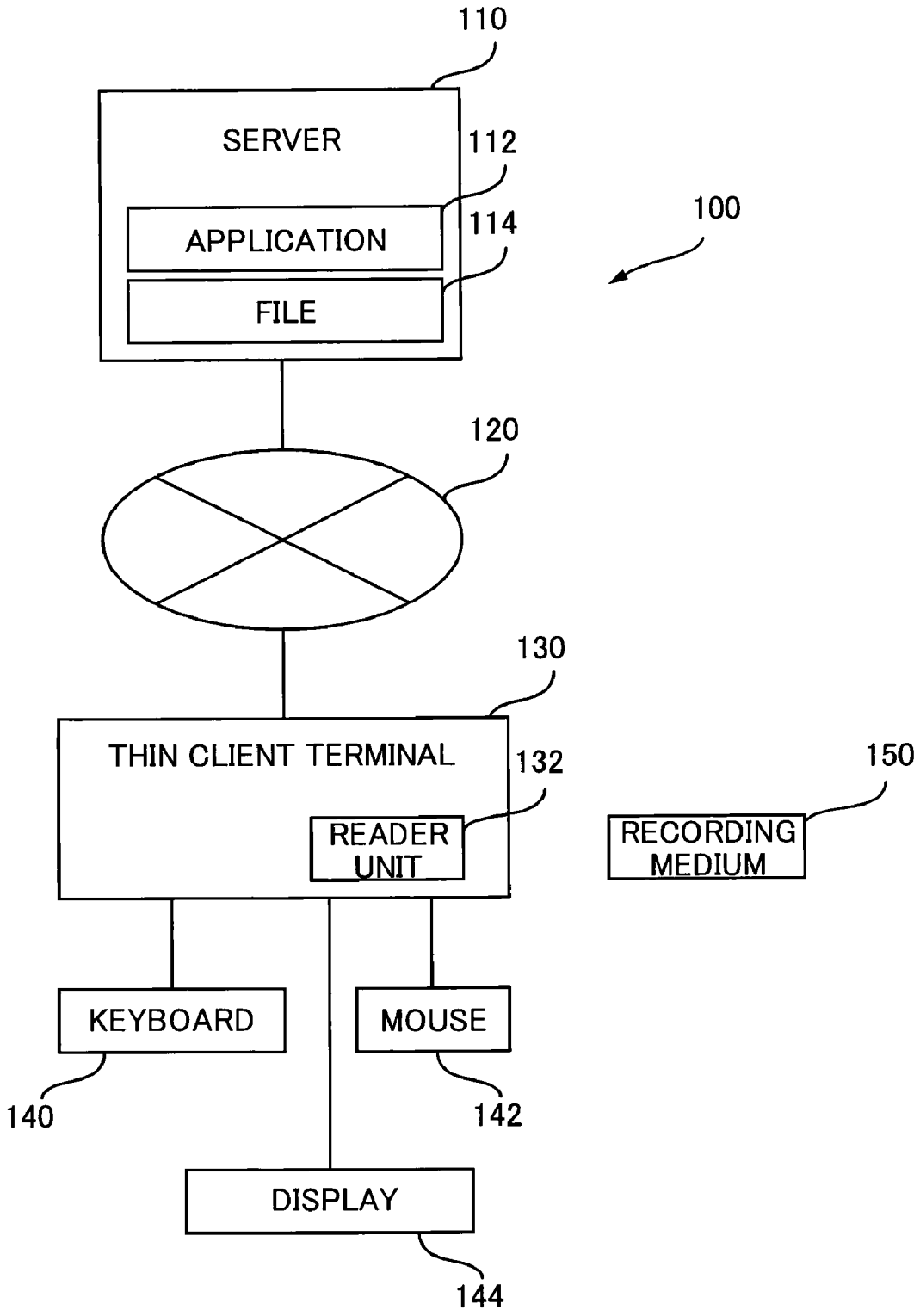
FIG. 1 illustrates the configuration of a thin client system.

A storage cabinet of this embodiment is to house a thin client terminal that is placed at the center of a number of participants sitting in a circle in a video conference and outputs images to display devices provided around the thin client terminal. FIG. 1 illustrates the configuration of a thin client system 100. As shown in FIG. 1, the thin client system 100 includes a server 110 and thin client terminals 130 that are connected to the server 110 via a network 120 such as a LAN, the Internet, or the Intranet. In the thin client system 100, the server 110 manages resources such as applications 112 and files 114 of users. The users handle the applications 112 activated in the server 110 or view the files 114 through the thin client terminals 130.

Each thin client terminals 130 has a reader unit 132 that can read authentication information from a card-like recording medium 150 on which the authentication information for authenticating its user is recorded. The reader unit 132 has a slot into which the recording medium 150 is to be inserted, and reads the authentication information from the card-like recording medium 150 inserted into the slot.

When each thin client terminal 130 reads the authentication information from the recording medium 150 with the reader unit 132, the authentication information is transmitted to the server 110 via the network 120, and the server 110 then performs user authentication based on the authentication information. When the user authentication by the server 110 is completed, the user is allowed to access the work area in the server 110 through the thin client terminal 130. In this manner, the work contents (for example, an activated application or file) can be viewed by the user, and the application activated in the server 110 can be operated through the thin client terminal 130.

The thin client terminals 130 are connected to the server 110 so that communications can be performed between the thin client terminals 130 and the server 110. Also, keyboards 140 and mouses 142 as input devices (though only one each is shown in FIG. 1) and display devices 144 (though only one is shown in FIG. 1) are connected to the thin client terminals 130.

Figure 2:
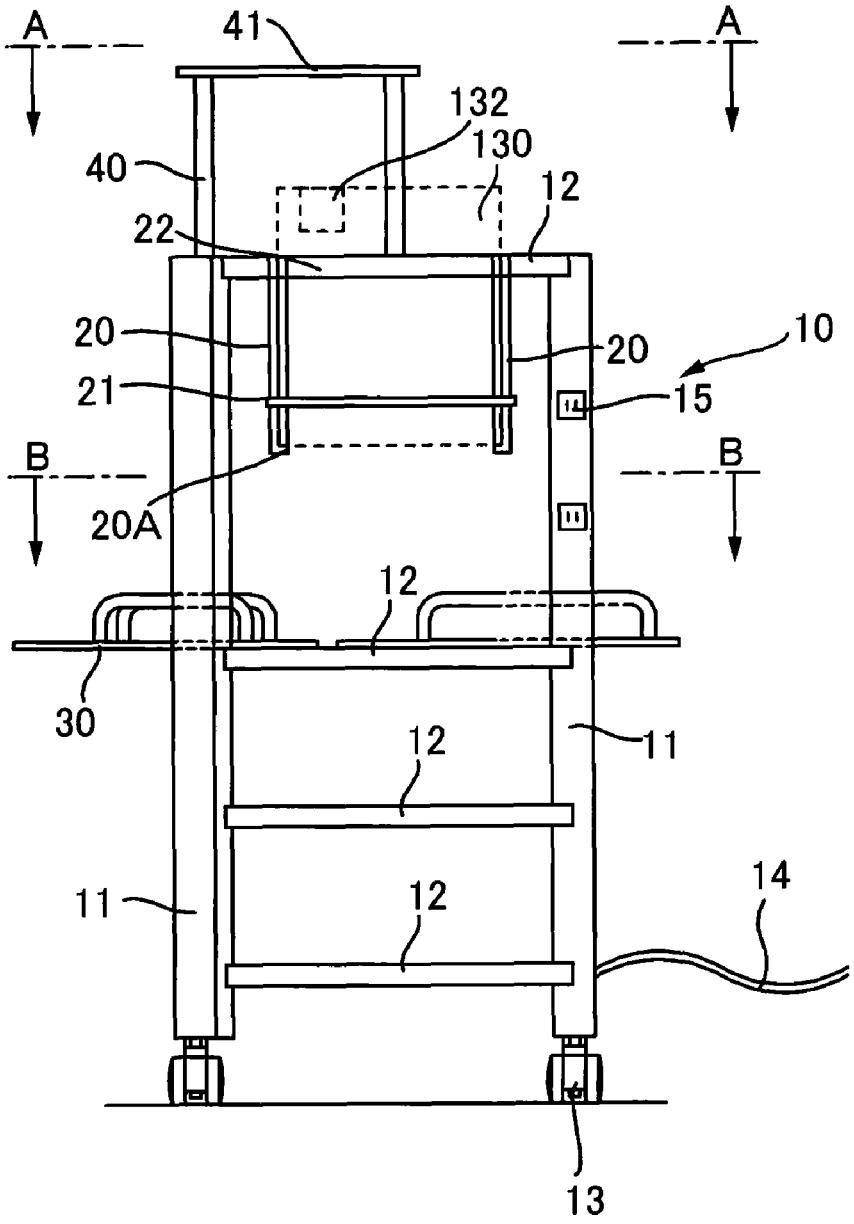
FIG. 2 is a front view of a storage cabinet of an embodiment of the present invention.
Figure 3:
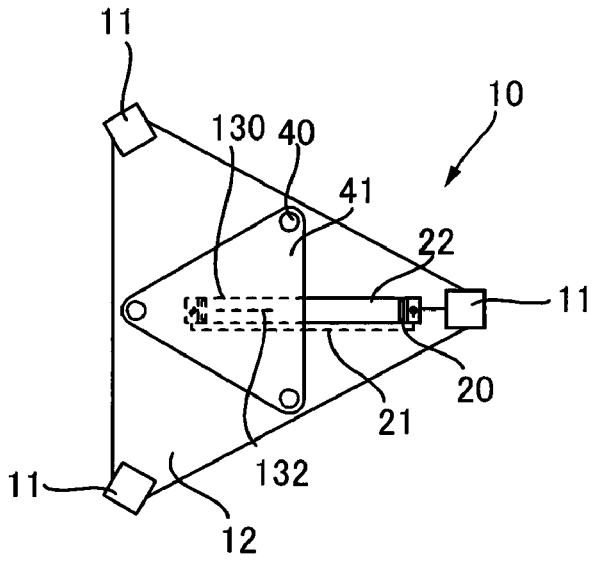
FIG. 3 is a view of the storage cabinet, seen from the direction indicated by the arrows A-A in FIG. 2.
Figure 4:
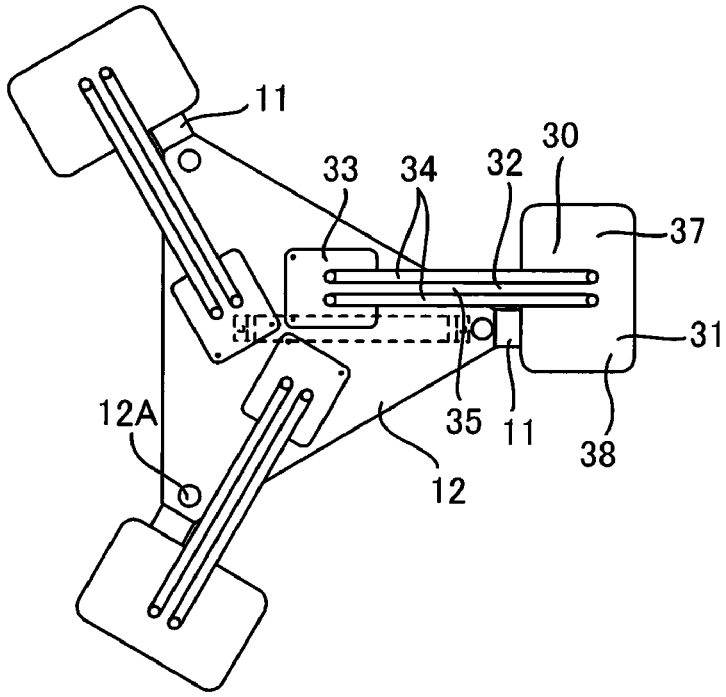
FIG. 4 is a view of the storage cabinet, seen from the direction indicated by the arrows B-B in FIG. 2.

As shown in FIGS. 2 through 4, the storage cabinet 10 is formed with four shelf boards 12 each having an equilateral-triangular shape when seen in a plan view, and pillars 11 that extend in the vertical direction through the corner points of the shelf boards 12 and support the shelf boards 12. The four shelf boards 12 are placed at intervals in the vertical direction. The number of shelf boards 12 is not limited to four, but may be three or less, or five or more.

The support pillars 11 may be hollow steel pillars, for example. An electric outlet 15 is provided at mid portions of each of the support pillars 11, and an electric cable 14 for supplying power to the electric outlet 15 extends from the electric outlet 15 toward the outside, passing through the inside and the bottom of the support pillar 11.

A wheel 13 is attached to the bottom end of each support pillar 11. With the wheels 13, the storage cabinet 10 can move back and forth, side to side, and around on the floor surface. If there is no need to move the storage cabinet 10, the wheels 13 may be omitted.

Figure 5:
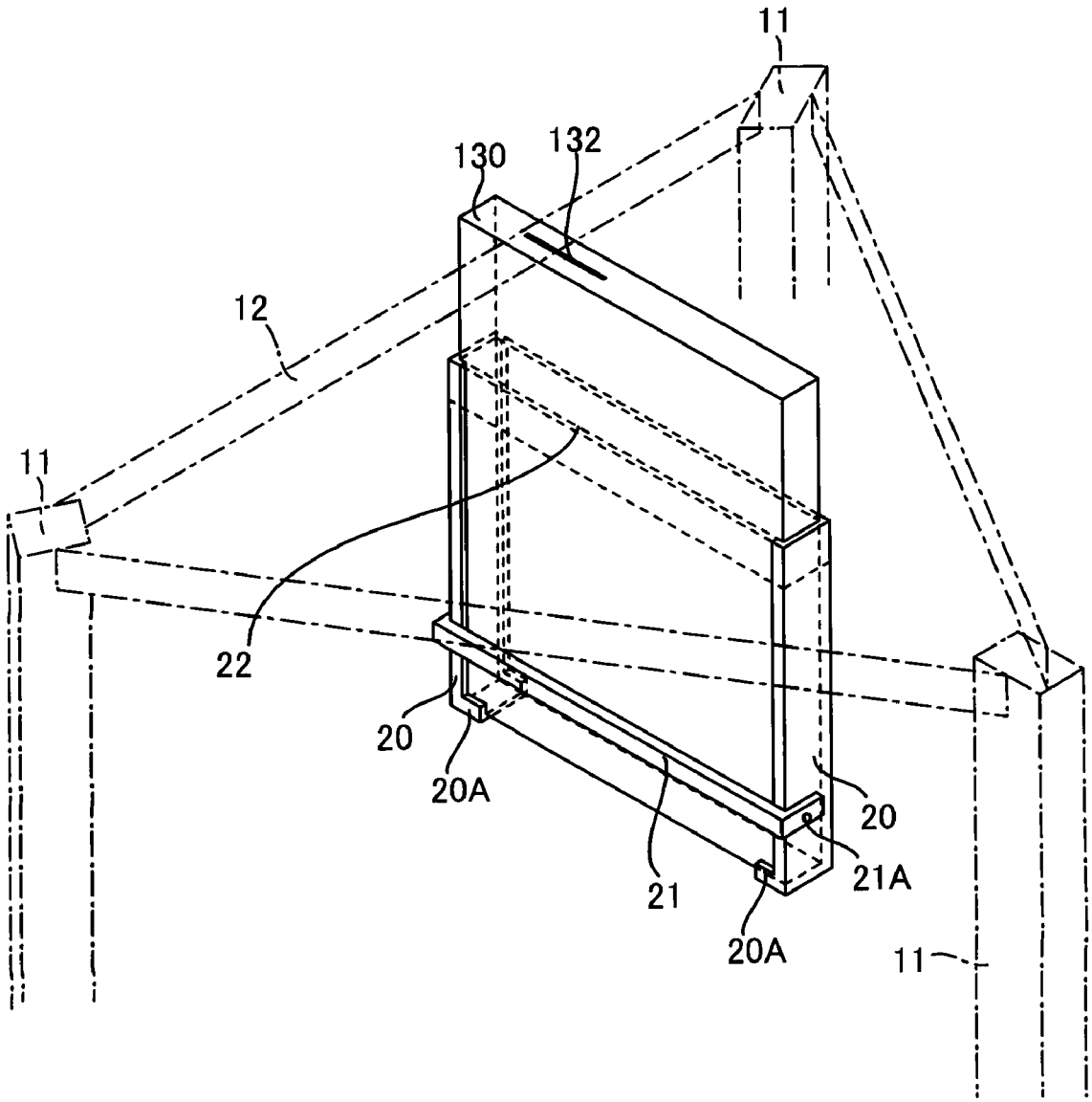
FIG. 5 is a perspective view of a structure in which a thin client terminal is housed in the storage cabinet.
Figure 6:
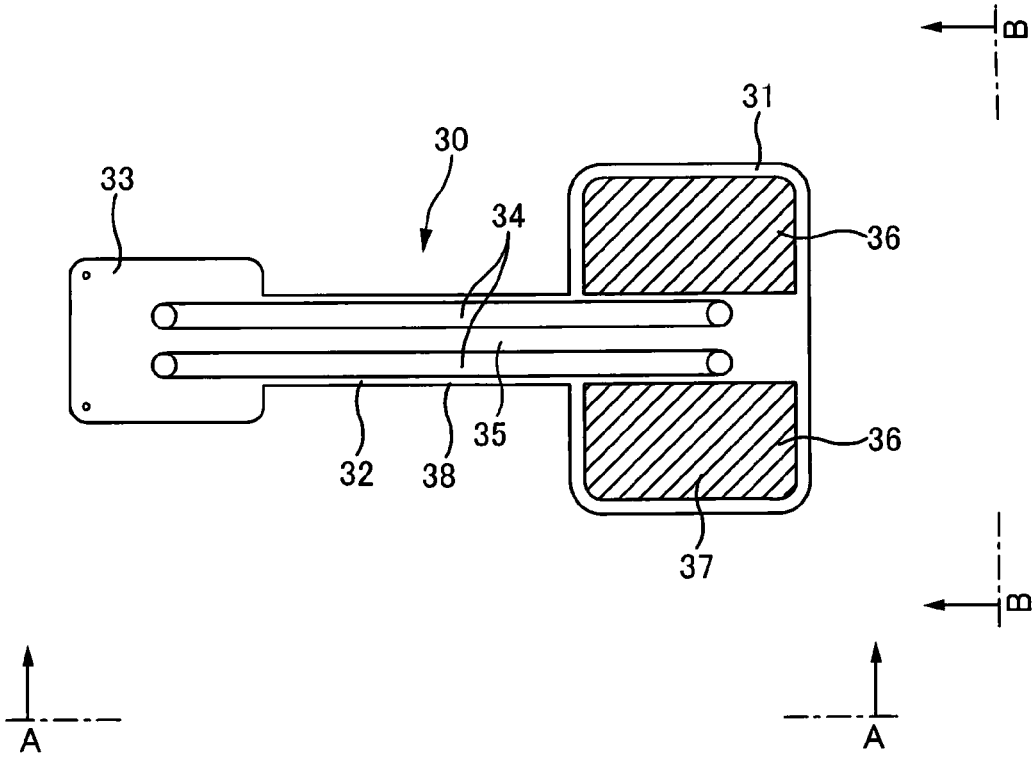
FIG. 6 is an elevation view of a storage unit attached to the storage cabinet.
Figure 7:
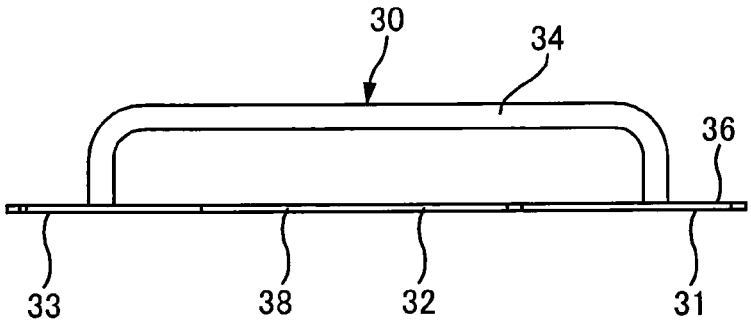
FIG. 7 is a view of the storage unit, seen from the direction indicated by the arrows A-A in FIG. 6.
Figure 8:
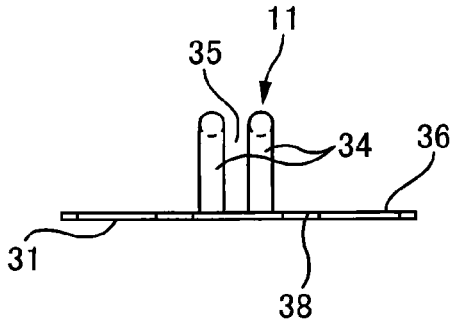
FIG. 8 is a view of the storage unit, seen from the direction indicated by the arrows B-B in FIG. 6.

As shown in FIG. 5, a rectangular opening 22 that extends from one of the corners of the uppermost shelf board 12 to the center point of the side facing the corner point is formed in the uppermost shelf board 12, so that a thin client terminal 130 can be inserted through the rectangular opening 22, with the reader unit 132 facing upward. At the both ends of the rectangular opening 22, a pair of holding members 20 each having a rectangular section minus a side are provided to extend vertically downward, with the opening sides of the holding members 20 facing each other. A bent portion 20A having an end bent in the horizontal direction is formed at the lower end of each holding member 20.

The pair of holding members 20 are linked to each other with a restraint member 21 extending in the horizontal direction. The two end portions of the restraint member 21 are bent at right angles, and the bent portions are fixed to the respective holding members 20 by screws 21A. The thin client terminal 130 is inserted into the opening 22 of the shelf board 12, with the reader unit 132 facing upward. The bent portions 20A of the holding members 20 support the bottom ends of the thin client terminal 130, with the reader unit 132 being located higher than the shelf board 12. As described above, the pair of holding members 20 are linked to each other with the restraint member 21, so that the holding members 20 are held and are prevented from bending apart from each other. Thus, the thin client terminal 130 accommodated between the holding members 20 can be prevented from dropping.

When the thin client terminal 130 is housed in the storage cabinet 10, the restraint member 21 is removed, and the bottom ends of the pair of holding members 20 are bent apart from each other, so that the thin client terminal 130 can be moved past the bent portions 20A. In this state, the thin client terminal 130 is inserted between the holding members 20 from the bottom with the reader unit 132 facing upward, and is then inserted into the opening 22 of the uppermost shelf board 12. The thin client terminal 130 is then positioned so that the bottom ends of the thin client terminal 130 are supported by the bent portions 20A of the holding members 20. The both ends of the restraint member 21 are then fixed to the holding members 20 by the screws 21A, so as to link the holding members 20 to each other with the restraint member 21. In this manner, the thin client terminal 130 is put into a supported state, with the reader unit 132 facing upward.

The thin client terminal 130 has end terminals on its bottom face. Those end terminals are to be connected to a communication cable for having communications with the server 110, an output cable for outputting images to display devices, an input cable extending from a mouse or keyboard, and a power supply cable. Each of the shelf boards 12 except for the uppermost one has a hole 12A at each corner portion, so that the respective cables connected to the thin client terminal 130 can be inserted into the holes 12A.

The shelf board 12 that is the second one from the top is attached approximately 10 cm to 20 cm below the bottom ends of the holding members 20, so that the above mentioned cables can be attached to the end terminals on the bottom face while the thin client terminal 130 is held in the above-described manner.

The storage cabinet 10 further includes a protection panel 41 that is designed to cover the space above the reader unit 132 of the thin client terminal 130 accommodated in the storage opening 22. The protection panel 41 has an equilateral-triangular shape, and the length of each side of the protection panel 41 is substantially half the length of each side of each shelf board 12. The protection panel 41 is supported by pillar members 40 at the respective corner portions. The pillar members 40 stand near the center points of the respective sides of the uppermost shelf board 12. The protection board 41 is supported in a position, for example, approximately 20 cm higher than the uppermost shelf board 12, so that the recording medium 150 can be inserted into the reader unit 132 by a user putting a hand between the lower face of the protection panel 41 and the upper portion of the thin client terminal 130, with the thin client terminal 130 being accommodated.

As described above, the protection panel 41 is provided to protect the space above the reader unit 132 of the thin client terminal 130. Thus, dust cannot easily enter the reader unit 132, and the reader unit 132 cannot be damaged by an object falling from the above.

When a video conference is held with a remote place, the participants of the conference might be captured by a television camera. In such a case, the television camera can be placed on the upper face of the protection panel 41.

Storage units 30 that have keyboard storing portions 35 and mouse storing portions 37 are provided onto the shelf board 12 that is the second one from the top. The storage units 30 are arranged at the respective corner portions of the shelf board 12 in a radial manner, with the center point of the shelf board 12 being the center of the radius.

The keyboard storing portions 35 has a pair of support frames 34 that are formed in U-like shapes by bending end portions of round pipes or round bars. The support frames 34 are arranged parallel to each other and at a predetermined distance (larger than the thickness of a keyboard) from each other. Each of the support frames 34 stands to form an upside-down U-like shape. The both ends of each of the support frames 34 are integrally bonded to the upper portion of a flat board 38 which will be described later by welding or the like. In this manner, the support frames 34 stand vertically from the upper portion of the flat board 38, and a keyboard is accommodated in a standing manner in the space formed between the pair of support members 34.

Each flat board 38 has a T-like shape when seen in a plan view including an attachment portion 33 formed with a rectangular board, a table portion 31 formed with a larger rectangular board than the attachment portion 33, and a linking portion 32 formed with a thin, long board member connecting the attachment portion 33 and the table portion 31. The pair of support frames 34 of the keyboard storing portion 35 stand vertically at the center of the upper portion of the flat board 38.

The mouse storing portions 37 are provided on the table portion 31 on both sides of the supporting frames 34, and a mouse can be placed on either of the mouse storing portions 37. A sheet-like slippage preventing mat 36 made of synthetic rubber or the like is integrally attached onto the upper face of each mouse storing portion 37 with an adhesive agent or the like. The slippage preventing mats 36 prevent a mouse thereon from slipping off the mouse storing portions 37.

The storage units 30 are attached to the storage cabinet 10 by fixing the attachment portions 33 onto the upper faces of the respective corner portions of the second shelf board 12 of the storage cabinet 10 with screws or the likes. In this case, the attachment positions of the attachment portions 33 of the storage units 30 onto the shelf board 12 are adjusted so that approximately half the length of each support frame 34 of the keyboard storing portions 35 exists on the upper portion of the shelf board 12, and the other half exits outside the shelf board 12. By placing the pairs of supporting frames 34 in such positions, approximately a half of each keyboard accommodated between each corresponding pair of support frames 34 exists on the upper portion of the shelf board 12, and the remaining half exists outside the shelf board 12. In this manner, keyboards can be readily put into and out of the keyboard storing portions 35 from the outside of the storage cabinet 10.

Figure 9:
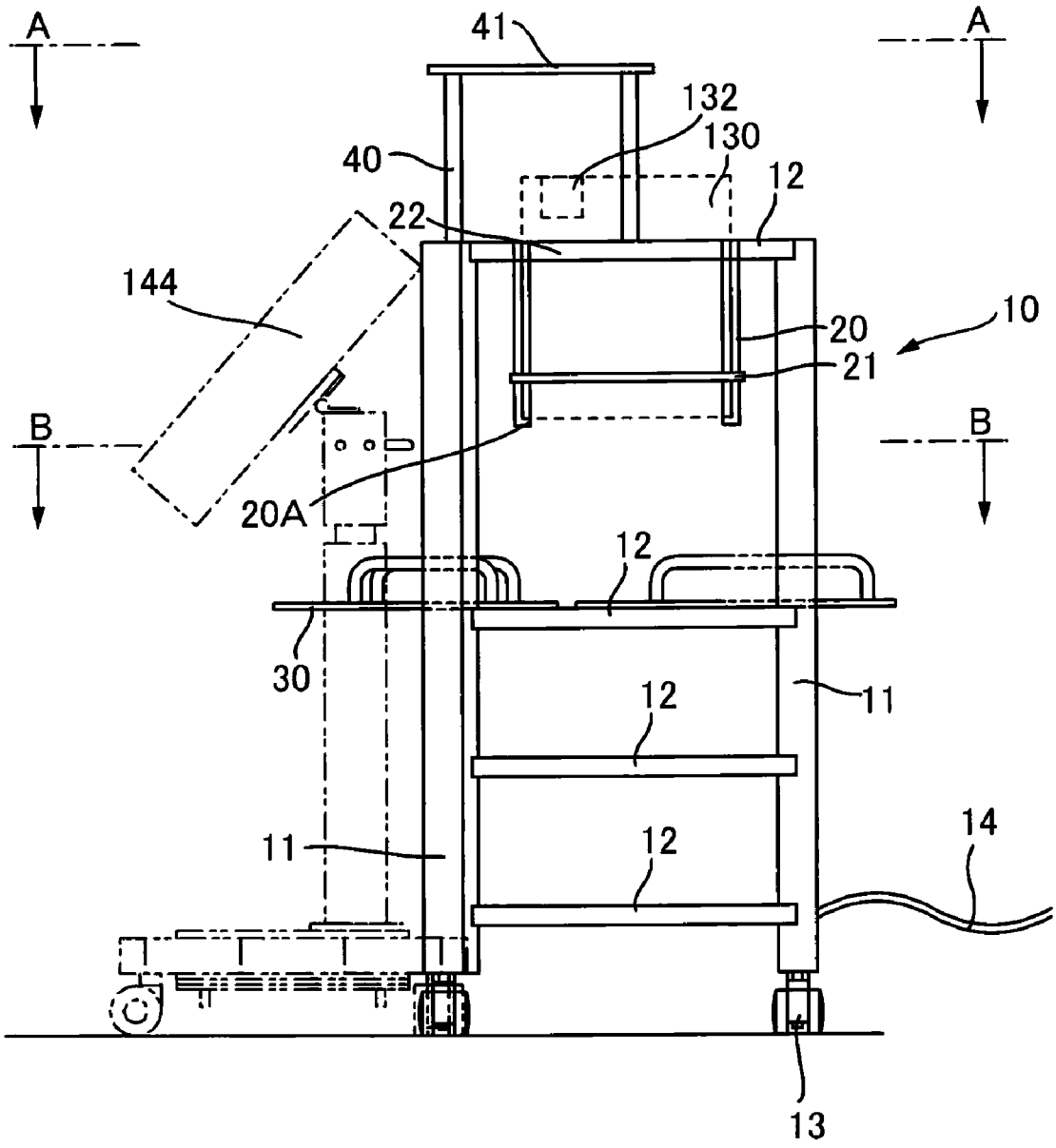
FIG. 9 is a front view for explaining a situation where a thin client terminal is housed in the storage cabinet, and a video conference is held.
Figure 10:
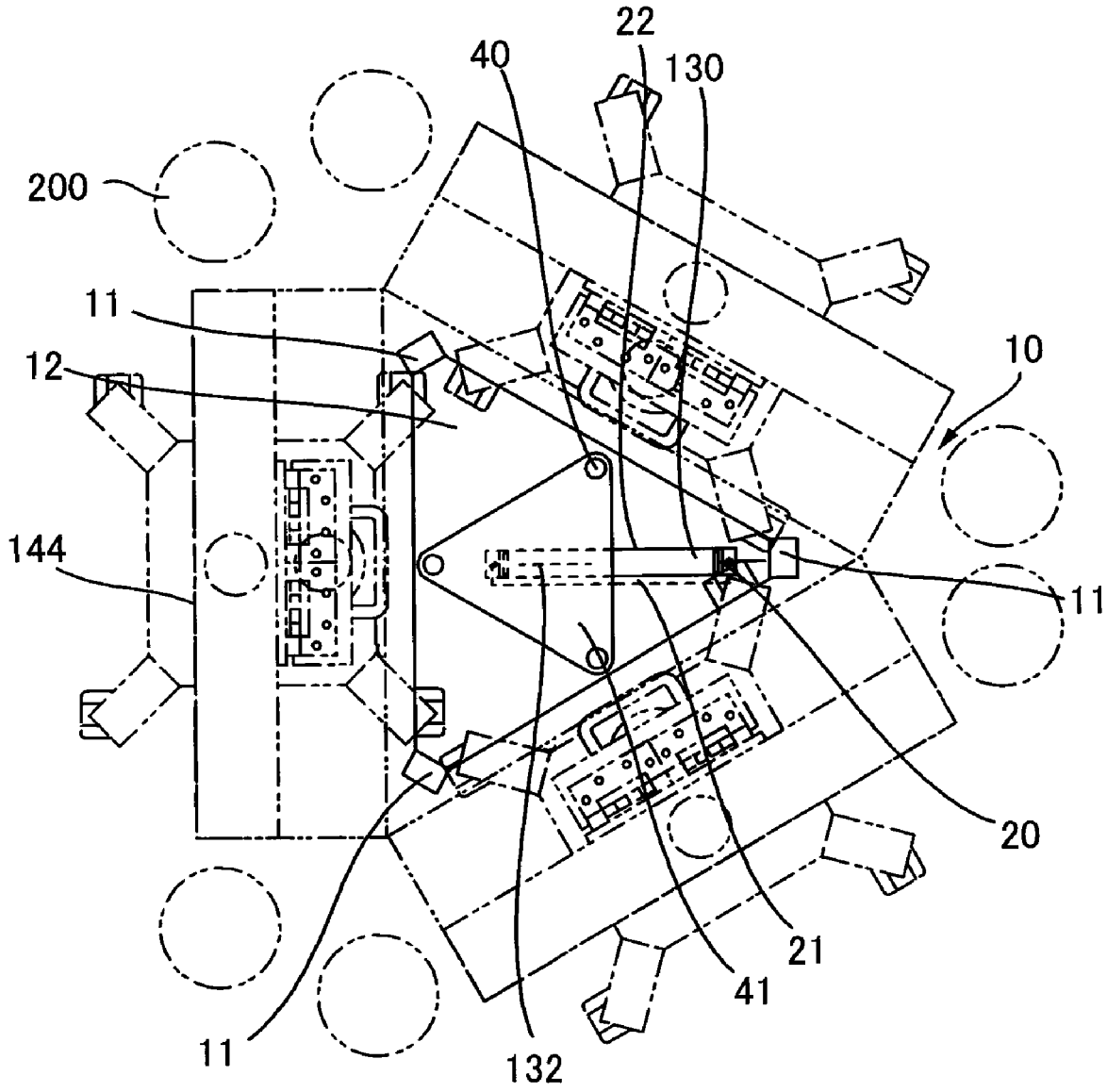
FIG. 10 is a view seen from the direction indicated by the arrows A-A in FIG. 9.
Figure 11:
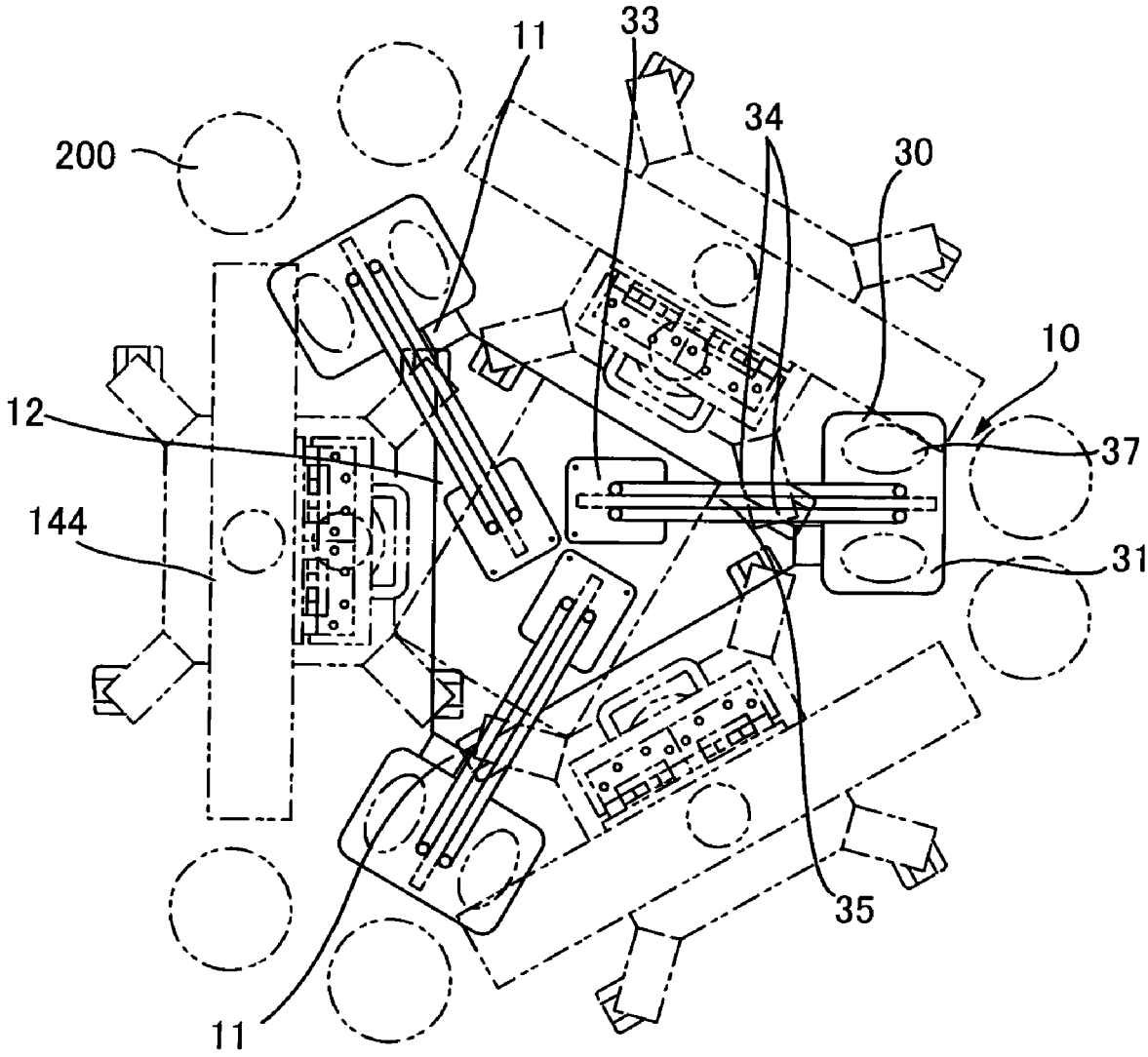
FIG. 11 is a view seen from the direction indicated by the arrows B-8 in FIG. 9.

To hold a video conference while the thin client terminal 130 is housed in the storage cabinet 10 of this embodiment, the storage cabinet 10 housing the thin client terminal 130 is placed in the center of the conference participants sitting in a circle, and the display devices 144 are placed in such a manner that the back face of each display device 144 is put into contact with each corresponding side of the storage cabinet 10, as shown in FIGS. 9 through 11. Each of the display devices 144 is preferably a device that has a display screen supported by a stand, and the height and angle of the display screen is preferably adjustable.

In a case where all the participants view a file created by one of the participants, the recording medium 150 having the authentication information about this participant recorded thereon is inserted into the reader unit 132 of the thin client terminal 130. Since the display devices 144 are placed on the respective side portions of the storage cabinet 10, a user can reach the reader unit 132 from one of the corner portions of the shelf boards 12, so as to avoid touching the display devices 144. In this manner, the recording medium 150 can be readily inserted into the reader unit 132. Also, since the thin client terminal 130 faces upward, any participant sitting in the circle can readily insert the recording medium 150 into the reader unit 132.

Since the support pillars 40 support the protection panel 41 in the vicinities of the mid portions of the respective sides of the shelf board 12, the support pillars 40 supporting the protection panel 41 do not hinder any user from inserting the recording medium 150 from one of the corner portions of the shelf board 12.

The participants then take out the keyboards from the keyboard storing portions 35 and the mouses from the mouse storing portions 37, and use them to operate applications activated in the server 110 and proceed with the conference. Here, the applications activated in the server 110 are displayed on each of the display devices 144.

When a file created by another participant is viewed, it is necessary to insert the recording medium 150 held by this participant into the reader unit 132. As described above, any participant can readily insert the recording medium 150 into the reader unit 132.

As described so far, in the storage cabinet 10 of this embodiment, the thin client terminal 130 is held so that the reader unit 132 faces upward. Accordingly, any participant can readily insert the recording medium 150 for authentication into the reader unit 132.

Dust may enter the reader unit 132, with the reader unit 132 facing upward in the above described manner. However, the protection panel 41 placed to cover the space above the reader unit 132 of the thin client terminal 130 protects the reader unit 132.

With the display devices 144 arranged around the storage cabinet 10, participants reach for the reading unit 132 from the corner portions of the shelf boards 12 so as to avoid the display devices 144, when the recording medium 150 is inserted into the reader unit 132. Since the protection panel 41 is supported by the support pillars 40 in the vicinities of the mid portions of the respective sides of the shelf boards 12, the support pillars 40 do not hinder the participants from reaching for the reader unit 132.

In this embodiment, the shelf boards 12 of the storage cabinet 10 each have an equilateral-triangular shape. However, the shelf boards 12 may have some other shapes. In the case where each of the shelf boards 12 has a polygonal shape, the support pillars 40 support the protection panel 41 at a distance from the straight lines connecting the corner portions of the shelf boards 12 and the reader unit 132 of the thin client terminal 130. In this manner, the support pillars 40 are prevented from becoming hindrance to insertion of the recording medium 150.

In this embodiment, a card-like recording medium is inserted into the insertion slot of the reading unit 132 to perform authentication. However, the present invention is not limited to that arrangement, and authentication may be performed by connecting a USB memory or the like, or may be performed with the use of a noncontact-type IC card or the like.

What is claimed is:

1. A storage cabinet that houses a terminal device having a reader unit for reading authentication information from a recording medium for authentication, comprising:

a board member that is supported in a horizontal direction, and has an opening into which the terminal device can be inserted, with the reader unit facing upward;

a holding member that holds the terminal device inserted into the board member, with the reader unit being located higher than the board member, and a protection member that is supported so as to cover a space above the reader unit of the terminal device inserted into the opening.

2. The storage cabinet according to claim 1, wherein the terminal device is a thin client terminal that forms a thin client system in cooperation with a server.

3. The storage cabinet according to claim 2, further comprising a storage unit that houses a keyboard and a mouse connected to the terminal device.

4. The storage cabinet according to claim 1, wherein:

the board member has a polygonal shape; and the protection member is supported by support pillars standing on the respective sides of the board member.

5. The storage cabinet according to claim 4, further comprising a storage unit that houses a keyboard and a mouse connected to the terminal device.

6. The storage cabinet according to claim 1, further comprising a storage unit that houses a keyboard and a mouse connected to the terminal device.

7. A video conference system comprising:

a storage cabinet that houses a terminal device having a reader unit for reading authentication information from a recording medium for authentication;

the terminal device that is housed in the storage cabinet; and display devices that are arranged around the storage cabinet, and display screens of the terminal device, the storage cabinet including:

a board member that is supported in a horizontal direction, and has an opening into which the terminal device can be inserted, with the reader unit facing upward; and a holding member that holds the terminal device inserted into the board member, with the reader unit being located higher than the board member.

8. The video conference system according to claim 7, wherein the terminal device is a thin client terminal that forms a thin client system in cooperation with a server.

9. The video conference system according to claim 7, wherein:

the board member has a polygonal shape; and the display devices are arranged at positions along the respective sides of the board member.

10. The video conference system according to claim 7, wherein the storage cabinet has a protection member that is supported so as to cover a space above the reader unit of the terminal device inserted into the opening; and the protection member is supported by support pillars standing on the respective sides of the board member.

11. The video conference system according to claim 7, wherein the storage cabinet further includes a storage unit that houses a keyboard and a mouse connected to the terminal device.

* * * * *